US005372461A

United States Patent [19]

Nanayakkara

[11] Patent Number: 5,372,461

[45] Date of Patent: * Dec. 13, 1994

[54] PASSIVE RESISTIVE RETAINING WALL STRUCTURE

[76] Inventor: Lakdas Nanayakkara, 28822 Pinewood Ct., Boca Raton, Fla. 33433

[ * ] Notice: The portion of the term of this patent subsequent to Jun. 29, 2010 has been disclaimed.

[21] Appl. No.: 25,424

[22] Filed: Mar. 1, 1993

Related U.S. Application Data

[63] Continuation-in-part of Ser. No. 921,815, Jul. 29, 1992, Pat. No. 5,222,836.

[51] Int. Cl.[5] ..... E02D 29/02

[52] U.S. Cl. ..... 405/262; 405/284

[58] Field of Search ..... 405/258, 262, 272, 273, 405/284, 285, 286

[56] References Cited

U.S. PATENT DOCUMENTS

| | | | |
|---|---|---|---|
| 1,762,343 | 6/1930 | Munster | 405/262 |
| 4,449,858 | 5/1984 | Hynds | 405/286 |
| 4,661,023 | 4/1987 | Hilfiker | 405/262 |
| 4,710,062 | 12/1987 | Vidal et al. | 405/262 |
| 4,804,299 | 2/1989 | Forte et al. | 405/285 |
| 4,968,186 | 11/1990 | Ogorchock | 405/262 |
| 5,222,836 | 6/1993 | Nanayakkara | 405/262 |

*Primary Examiner*—David H. Corbin
*Attorney, Agent, or Firm*—M. K. Silverman

[57] ABSTRACT

An earth retaining wall system is defined by a rectilinear three-dimensional matrix of tie elements, each substantially uniplanar in a horizontal plane and longitudinally elongated in a direction transverse to the retaining wall. Such tie elements are each rigidly coupled along one horizontal axis edge of an earth supporting side of the retaining wall. The tie element thusly defines a matrix or grid in a vertical plane. The system also includes passive pressure resistive members that are substantially uniplanar in a vertical plane which is also co-planar with the retaining wall. Such pressure resistive members are longitudinally elongated along a horizontal axis which is co-parallel with the retaining wall. Each of the pressure resistive members are rigidly secured to a surface of each tie element to define, in cross-section, a matrix in a vertical plane which is also normal to the retaining wall.

26 Claims, 14 Drawing Sheets

PASSIVE RESISTIVE RETAINING WALL STRUCTURE

REFERENCE TO RELATED APPLICATION

This is a continuation-in-part of application Ser. No. 07/921,815, filed Jul. 29, 1992, entitled Passive Resistive Retaining Wall Structure, now U.S. Pat. No. 5,222,836.

BACKGROUND OF THE INVENTION

The present invention relates to a passive resistive retaining wall system composed of a three-dimensional matrix of rectilinear elements.

State-of-the-art earth-retaining walls are, for their functionality, reliant upon tension developed by reinforcement between the so-called tie elements thereof which are embedded within the earth behind the physical surface of the retaining wall. Such reinforcement tension is generated by friction between the tie, its related elements and the earth fill itself which operates as a cantilever to prevent movement or shifting of the wall relative to the earth fill.

An aspect of such prior art retaining wall systems is that walls of considerable height and width, as well as associated footings extending to a substantial distance behind and in front of the retaining wall are required. For example, it would not be unusual to have a retaining wall of a height of twenty feet with a footing of fourteen feet of which four feet would be in front of the retaining wall and ten feet behind. Also, it would not be unusual for the retaining wall itself to have a thickness of two feet. The present invention, as is set forth below, responds to the above difficulties of the prior art and thereby provides a retaining wall system by which a wall structure of the above parameters can be replaced by a wall having a thickness of one-half foot and footing of two feet, nine inches in front and nine inches behind the retaining wall. Also, the height of a structure made in accordance with the present invention can be reduced because of the lessened potential for shifting of the earth when the inventive system is employed.

The prior art, as is known to the inventor, is reflected in U.S. Pat. No. 4,804,299 (1989) to Forte et al, entitled Retaining Wall System. The teaching thereof, while making use of certain rectilinear elements, does not teach or suggest the particular three dimensional matrix taught by the invention herein. Particularly, it does not teach the use of any earth supporting elements which are co-planar with the retaining wall.

SUMMARY OF THE INVENTION

The instant invention relates to an earth-retaining wall system, definable with reference to x, y and z Cartesian coordinate axes, for use with a retaining wall operative in the yz plane thereof. The system more particularly comprises a plurality of tie elements substantially uniplanar in the xy plane and longitudinally elongated along the x-axis. Said tie elements are each complementally rigidly coupled, along one y-axis edge thereof, to an earth supporting surface of said retaining wall, in a y-by-z axes matrix. The inventive system further includes a plurality of pressure resistive members substantially uniplanar in the yz plane and longitudinally elongated along the y-axis, each of said pressure resistive members rigidly secured along one y-axis edge thereof to xy plane of said tie elements in the same z-axis elevation of said y-by-z matrix of tie elements, said pressure resistive members defining, in transverse cross-section, an x-by-z axis matrix.

It is an object of the present invention to provide a three-dimensional structure for stabilization of an earth retaining wall that will reduce the wall thickness, footing width and wall height necessary to retain or stabilize a volume of earth having given x, y and z axis dimensions.

It is another object of the invention to provide a retaining wall system of the above type which will make use of principles of passive resistance.

It is a further object of the invention to provide a retaining wall system which may be fabricated using components which will result in a system more cost-effective than prior art retaining wall systems.

It is yet a further object to provide a retaining wall system that may be assembled at the work site from a plurality of modular components.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
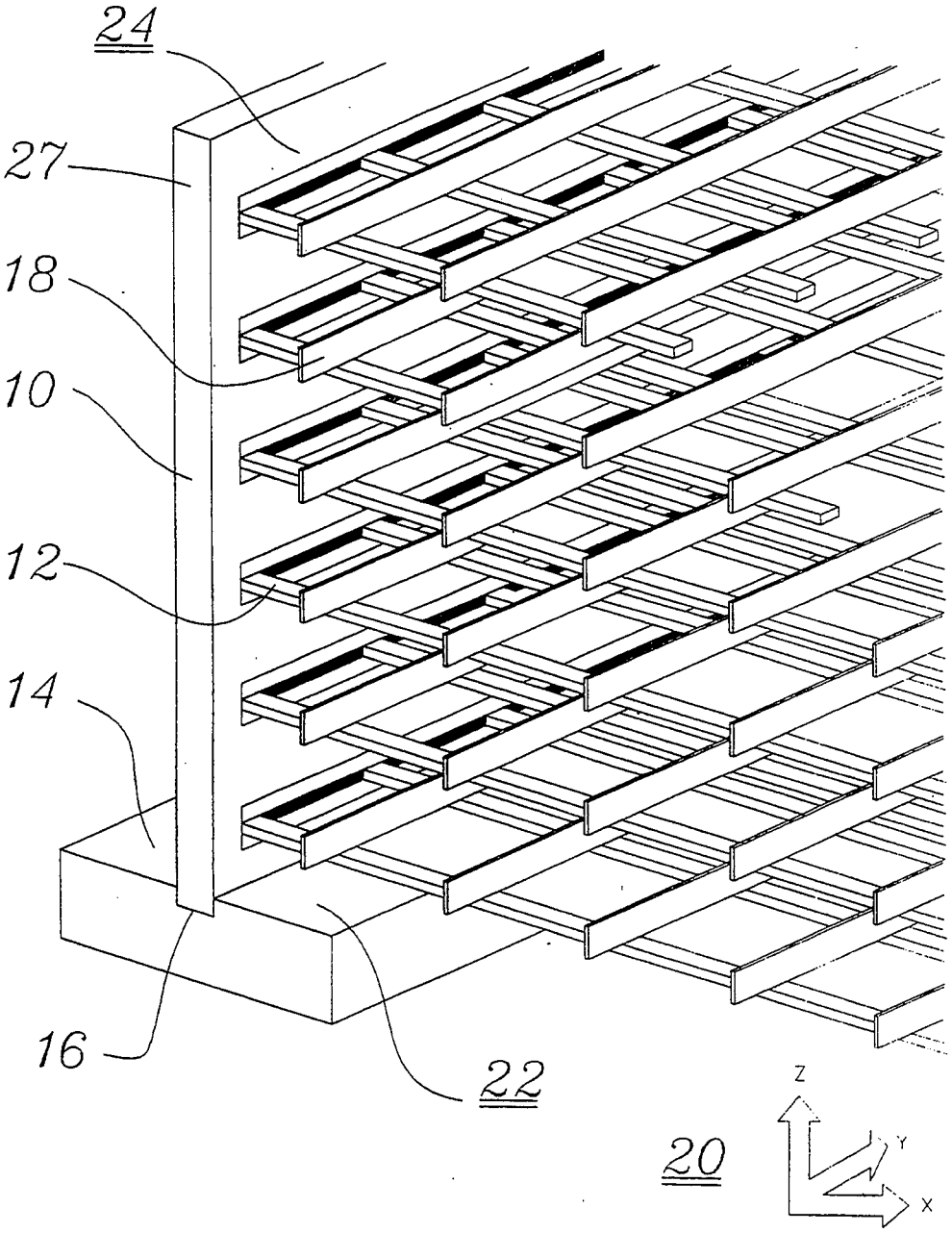
FIG. 1 is a perspective conceptual view showing the respective rectilinear components of the inventive retaining wall system.

With reference to the conceptual view of FIG. 1 there is seen therein a Cartesian coordinate axis consisting of orthonormal axes x, y, and z. These axes, in the context of the instant invention, include the axis of the gravity vector, this being the z-axis of the coordinate system, a y-axis which corresponds to the direction of the major axis of a retaining wall 10, and an x-axis which corresponds to the major axes of tie elements 12, described below in detail, which are situated normal to said retaining wall 10.

In FIG. 1 there is also shown a retaining wall footing 14 which, as may be noted, possesses a longitudinal axis in the y-direction, a secondary axis in the x-direction and tertiary-axis in the z-direction. The footing is complementally secured along the x-axis at a bottom 16 to the retaining wall 10. As will be appreciated from the foregoing description of the invention, the dimensions of retaining wall 10 and footing 14 are considerably less than would be the case in the use of prior art retaining wall systems, as is set forth in the Background of the Invention.

With further reference to FIG. 1 the inventive system is seen to comprise a three-dimensional matrix of elements which includes a plurality of said tie elements 12 and, normal thereto, a plurality of pressure resistive members 18. The inventive matrix of elements 12 and members 18 is defined by a number of special rectilinear relationships between said elements and the retaining wall 10. More particularly, as may be noted with reference to the views of FIGS. 1, 2, 4 and 6, each element 12 possesses a longitudinal or major axis in the x-direction, while possessing a secondary axis in the y-direction in which the width of each tie 12 element in the z-direction is minimal, for example, one inch. Accordingly, element 12 constitutes an elongated element in the xy plane which, thereby, renders it substantially co-planar with ground 20 and the xy surface 22 of footing 14. Further, as may be noted, the xy plane defined by each tie element 12 is orthonormal to inner surface 24 of retaining wall 10.

Figure 2:
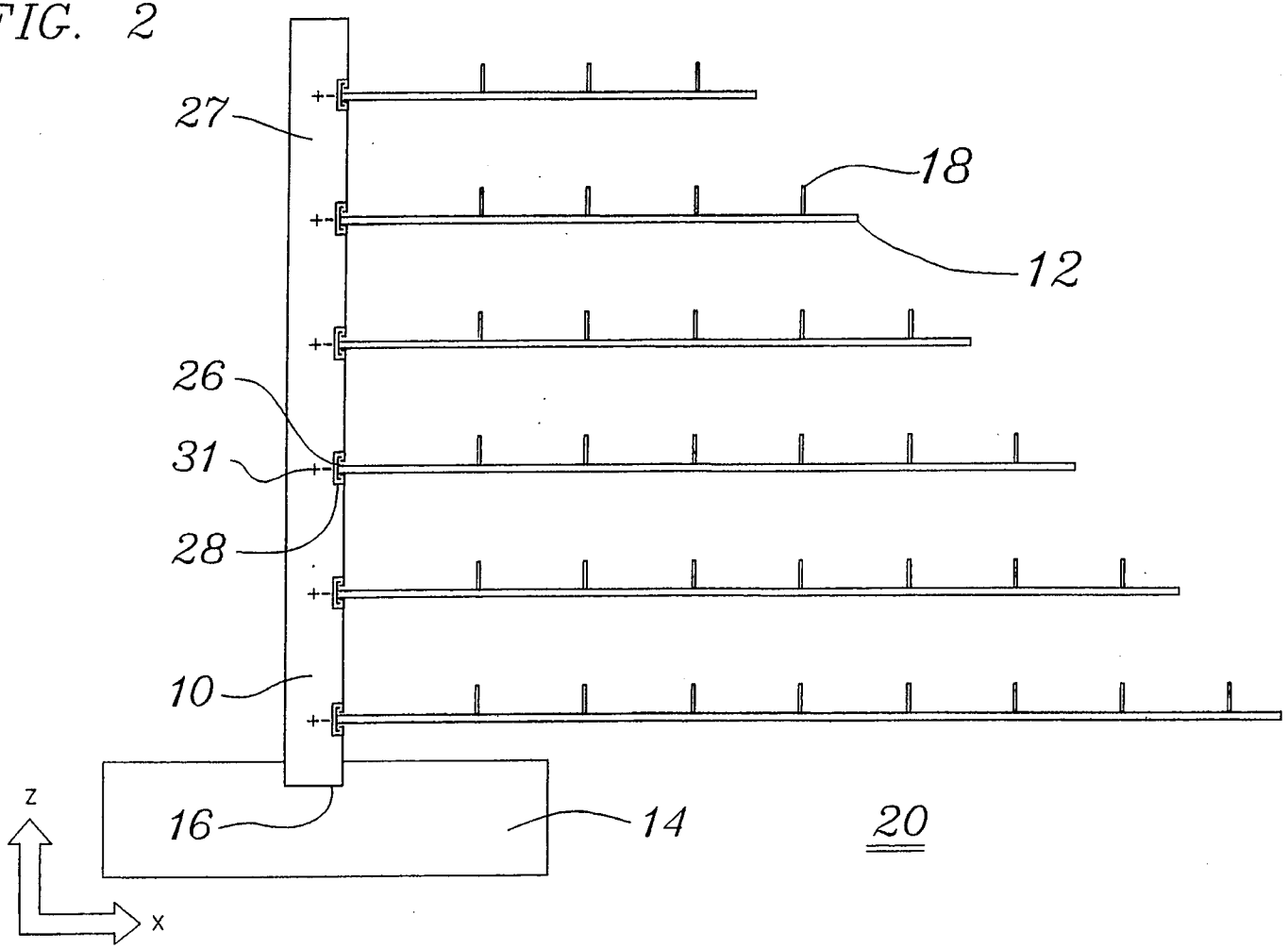
FIG. 2 is a side plan view of the system shown in FIG. 1 taken in the xz plane thereof.
Figure 6:
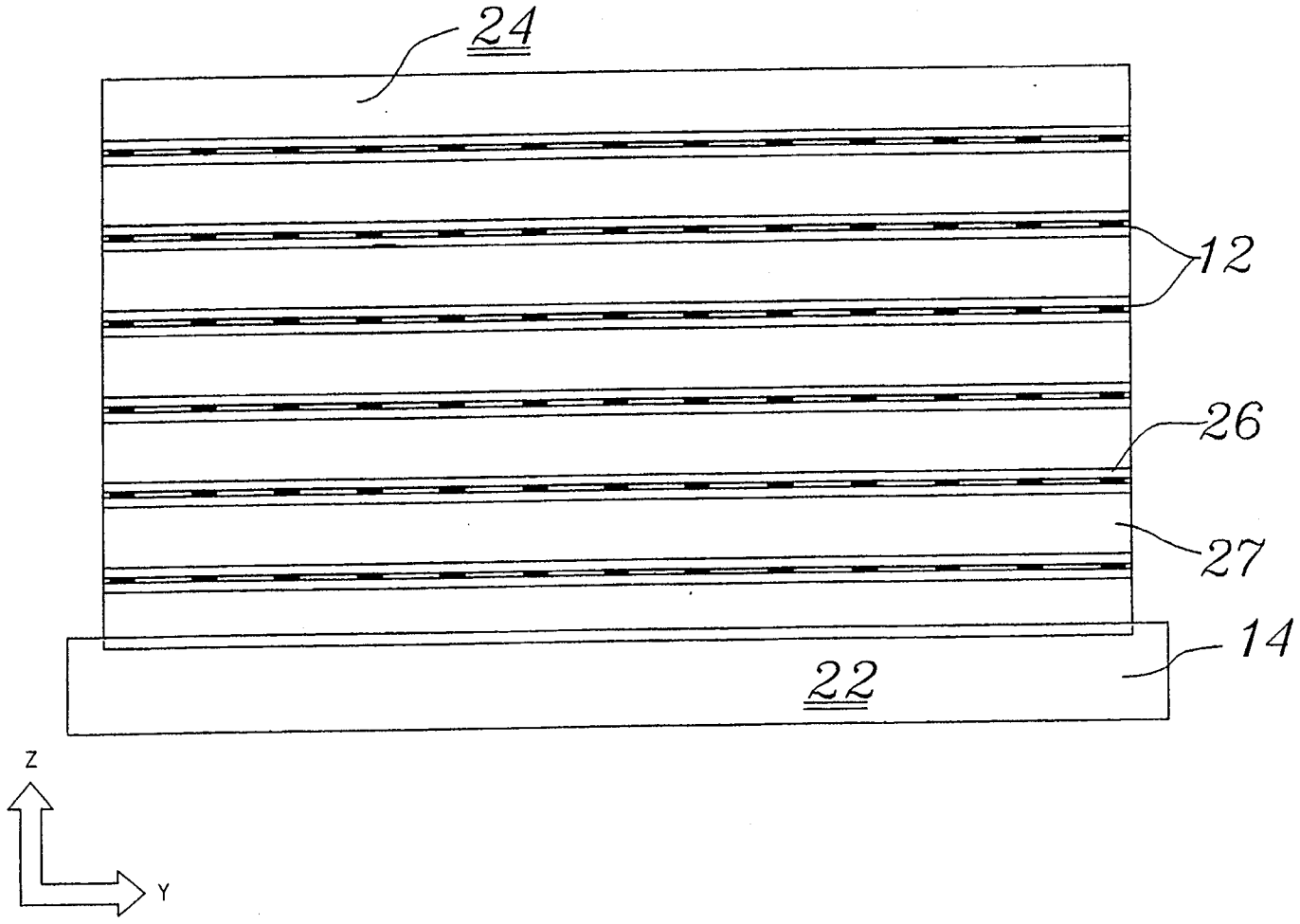
FIG. 6 is a plan view of the earth supporting surface of the retaining wall showing the location of the tie elements of the system, taken in the yz plane of the system.
Figure 7:
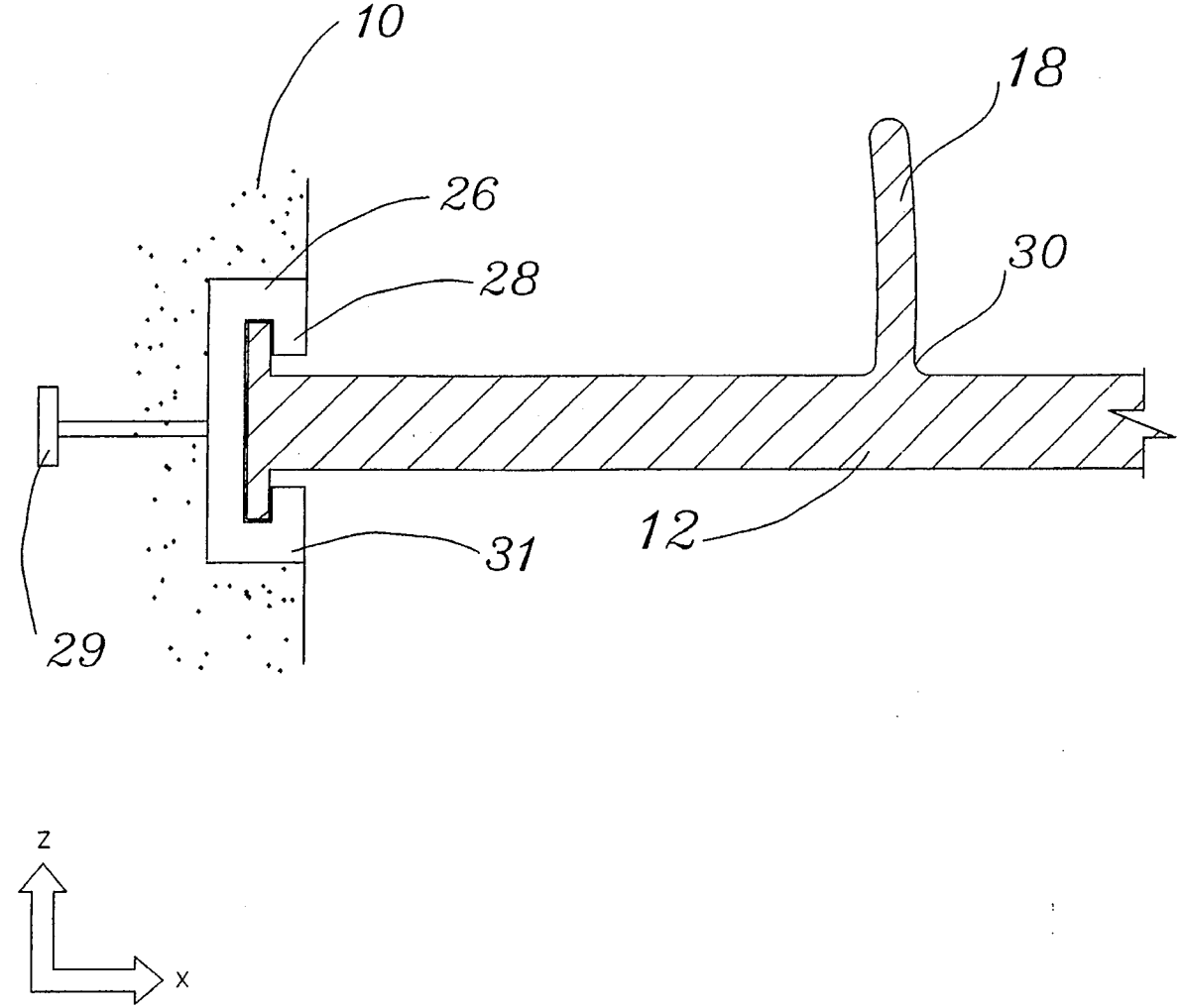
FIG. 7 is an enlarged view of the tie element anchoring to the retaining wall, this being the enlarged area indicated in FIG. 2. Also shown is the integral connection between the tie element and the passive resistive member.

Said elements 12 are secured to inner surface 24 of retaining wall 10 in the manner shown in FIGS. 2 and 7, that is, by means of a male-female coupling in which, more particularly, a flange end 26 of element 12 is slipped into an xz-plane surface 27 of the retaining wall into a C-shaped female channel 28. Said channel 28 and its associated stabilizing hardware 31 are formed as a part of the casting process of retaining wall 10. In other words, at the time of formation of retaining wall 10, female channel 28 and its associated stabilizing hardware 31 are positioned in concrete (or any other rigid material) as a part of the casting process of the retaining wall. Accordingly, xz-plane surface 27 of retaining wall 10 in FIGS. 1, 2 and 7 provide female channel 28 within which said tie element 12 and its associated flange end 26 may be inserted and then advanced in the y-axis direction until it has reached its desired location along the y-axis within the overall yz-matrix, shown in FIG. 6.

With respect to said pressure resistive members 18, these elements are, in the manner shown in greater detail in FIG. 7, formed normally to said tie elements 12 and co-planar with the yz surfaces of element 12. Further, the rectilinear structure of pressure resistive members 18 is that of a primary axis in the y-direction and a secondary axis in the z-direction to thereby define a planar surface in the yz-plane which is thereby co-planar with surface 24 of retaining wall 10. The tertiary axis of the structure, which exists in the x-axis, is approximately one-quarter inch in width. It is also noted that the members 18 may be non-continuous in the y-axis. Pressure resistive members 18 may be slidably inserted within grooves 30 within tie element 12 to achieve the necessary orthonormal relationship between yz plane of resistive number 18 and the xy plane of tie element 12. Also, members 18 may be secured to elements 12 by welding-casting or other means.

The z-axis dimension of pressure resistive members 18 is such that the upper edge thereof is not permitted to reach the lower surface of the tie 12 which is thereabove. This arrangement may be more fully appreciated by reference to the side view of FIG. 2. The z-axis height of each member 18 is about one-tenth of the z-axis distance between tie elements. Therein it may also be seen the complemental coupling between flange end 26 of tie element 12 and female channel 28.

Figure 4:
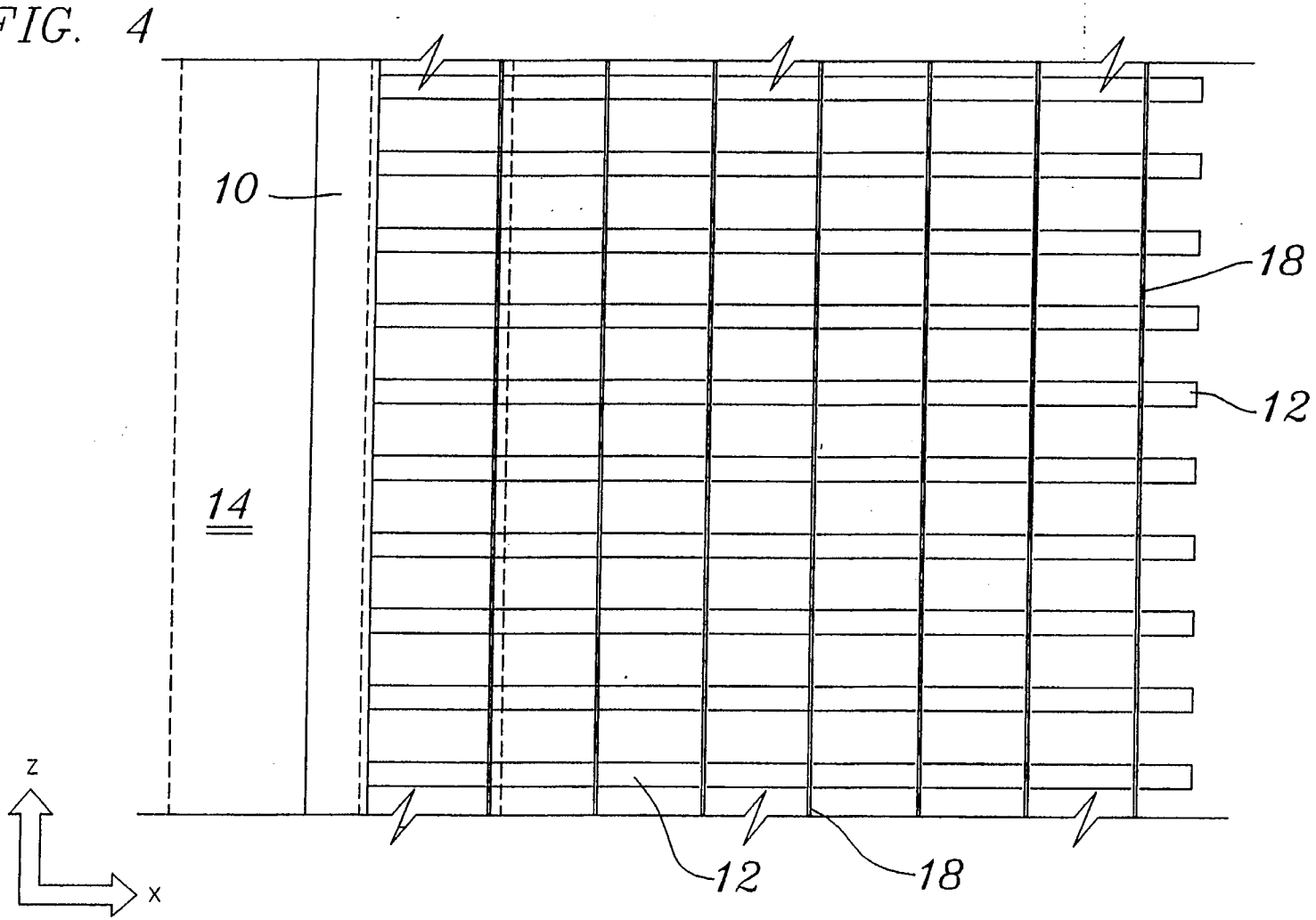
FIG. 4 is a top plan view of the system shown in FIG. 1 taken in the xy plane thereof.
Figure 5:
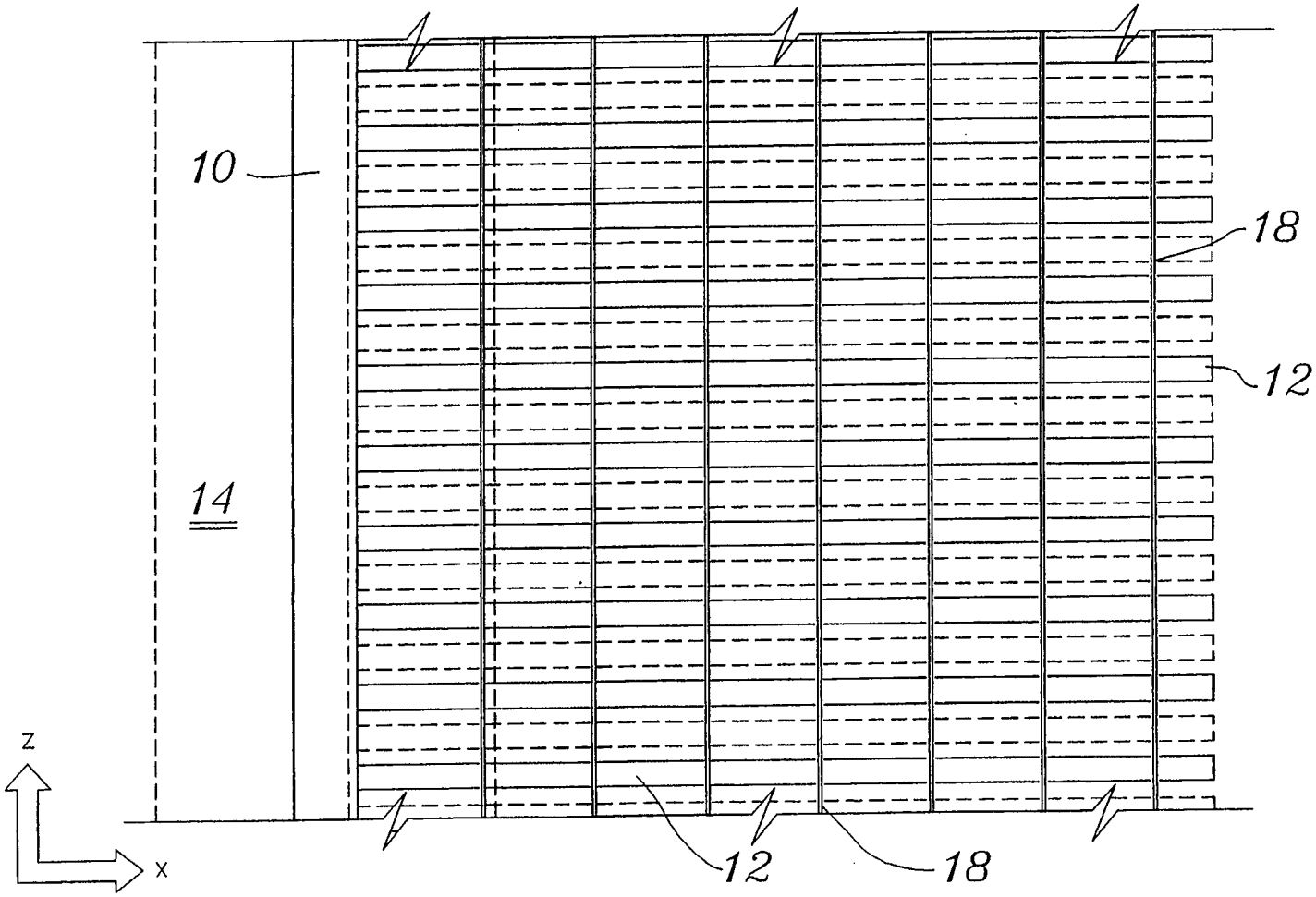
FIG. 5 is a top plan view in the xy plane of a second embodiment of the invention.

The inventive passive resistance matrix is shown in top view in FIG. 4, that is, in the xy plane of the structure, such plane substantially parallel with ground 20. As may be noted therein, pressure resistive members 18 extend, co-parallel with retaining wall 10, in the y-direction acting to thereby join a plurality of tie elements 12 which may consist of as few as a two tie elements or, in a given application, as many as required by the wall length. The y-axis length of tie elements 12 is about double the distance between them at any given z-axis elevation.

As may be also noted in the view of FIG. 4, a given matrix may consist of many pressure resistive elements 18 such that the overall appearance, in the xy plane of the inventive matrix, need not necessarily be that of a square as shown in FIG. 4 but, in a given embodiment, may be more rectangular in nature in which either the x- or the y-axis becomes the primary axis from a top view thereof. The number of pressure resistant members 18 utilized in the x-axis direction is a function of the square of the z-axis height of the system. Other variables that will influence the parameters of the rectilinear matrix are the height of the wall, the density of the backfill, the cohesiveness of the backfill, the angle of the friction of the backfill, the moisture content, the height of the water table, and the impost load on the ground by the wall.

Figure 8A:
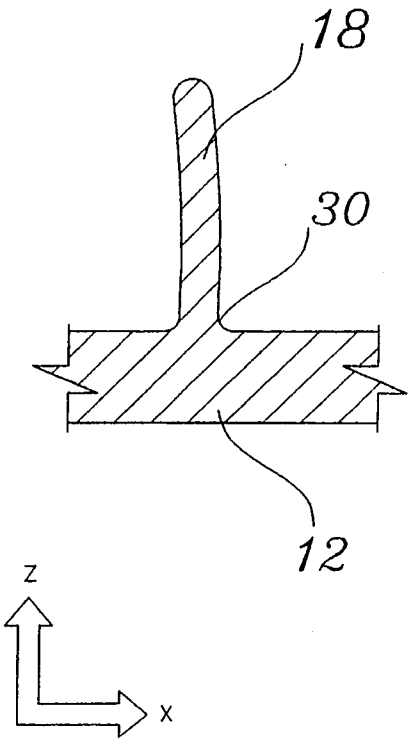
FIGS. 8A, 8B and 8C are views of various embodiments of the pressure resistive member.
Figure 8B:
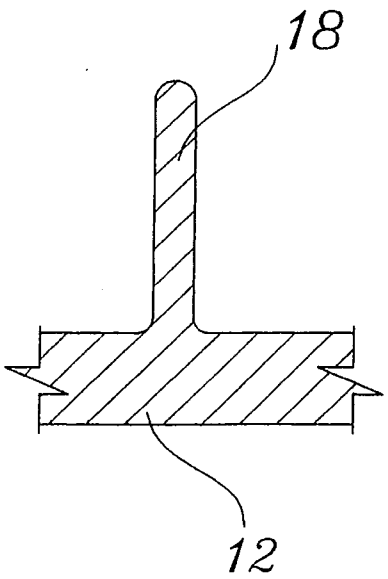
Figure 8C:
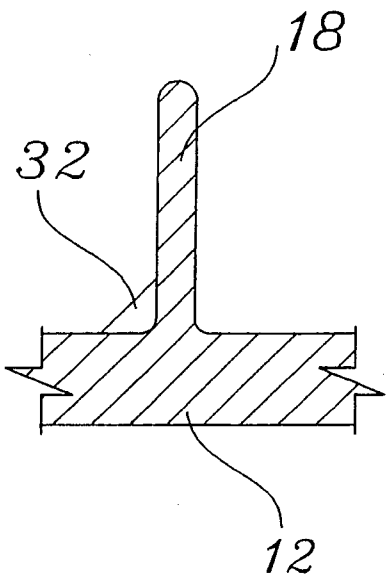

With reference to FIG. 8 there is shown therein an enlarged view of tie element 12, similar to the view of FIG. 6 showing, however, possible xz plane cross-sectional configurations that may be applicable to the resistive members 18. As may be noted in the view of FIG. 8 the resistive members are quite thin. The possible configurations shown in FIG. 8 include configuration A in which member 18 exhibits a bend or tilt in the direction of surface 24 of retaining wall 10. In configuration B no such tilt exists (this being the structure shown in FIG. 2), while in configuration C member 18 is shown provided with a solid triangular base or buttress 32, the purpose thereof being to provide greater stability to member 18 against movement of earth which may occur over time in the use of the inventive system.

Figure 3:
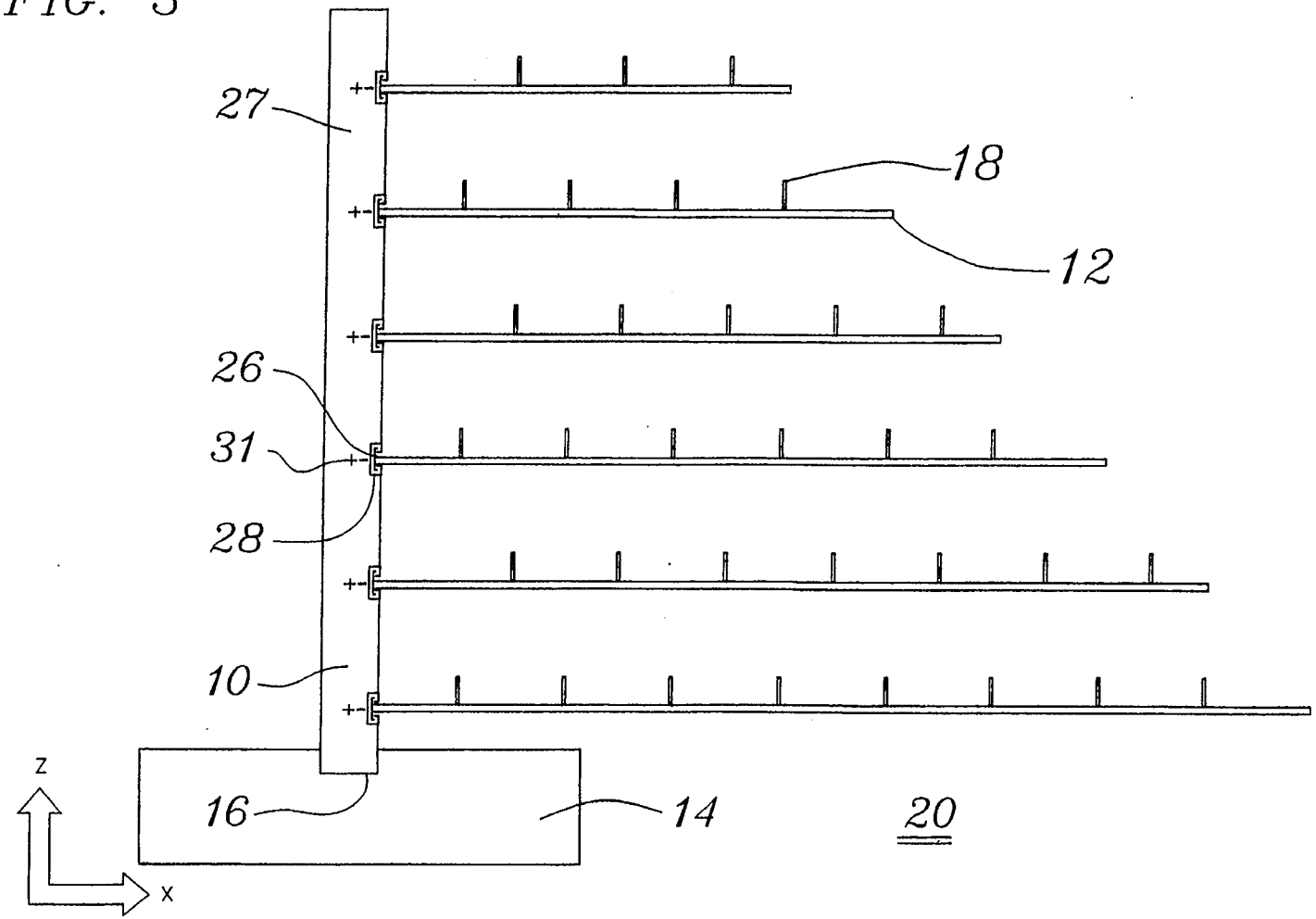
FIG. 3 is a side plan view in the xz plane of a second embodiment of the invention.
Figure 9:
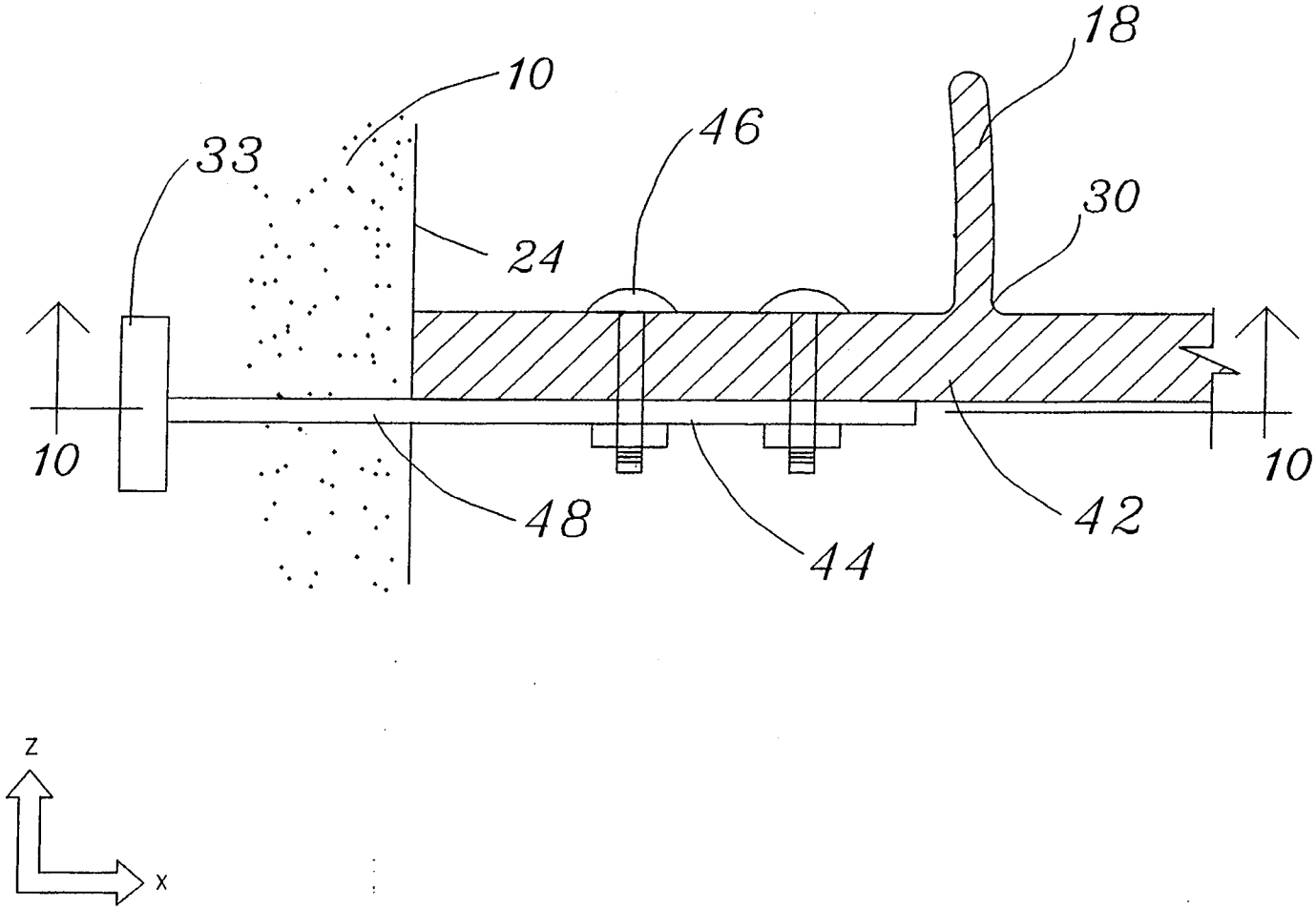
FIG. 9 is an enlarged view of an alternate embodiment of the tie element anchored to the retaining wall, this being an embodiment alternative to the embodiment of FIG. 7.
Figure 10:
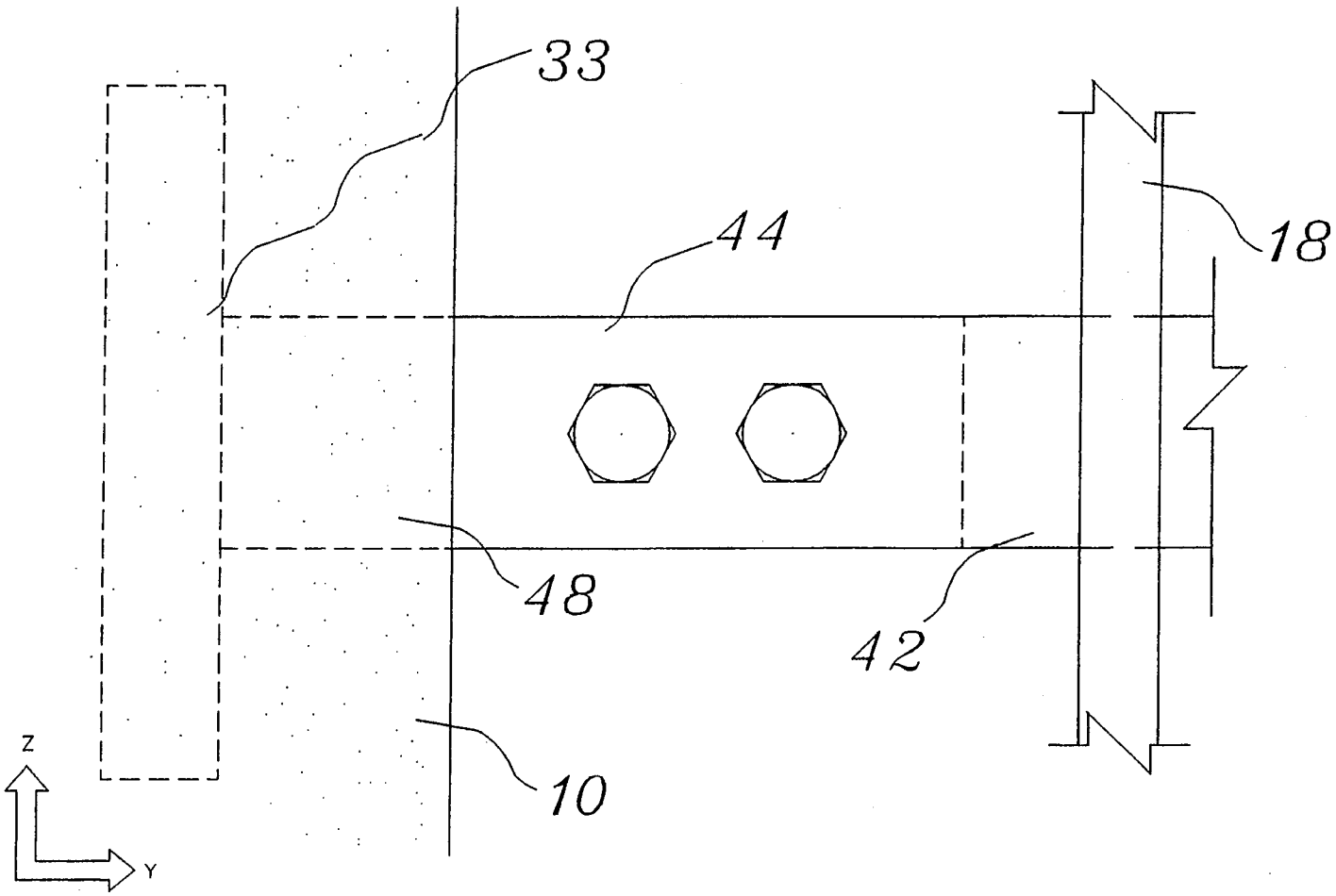
FIG. 10 is a top cross-sectional view taken along Line 10—10 of FIG. 9.

With reference to the views of FIGS. 9 and 10 there is shown an alternative embodiment of tie element 12 which, in said, views take the form of elements 42 and 44. As may be noted therein, said tie elements 42 and 44 are connected by bolts 46 while proximal end 48 of the element 44 is embedded within wall 10 through the use of anchor 33. This embodiment affords certain efficiencies in the it avoids the usage of grooves 31 (see FIGS. 2, 3 and 7) and the labor associated with the insertion of tie elements 12 thereinto. Accordingly, in the embodiment of FIGS. 9 and 10, tie elements 44 are, with anchors 33, cast directly into the cement wall 10. Therefore, the connection thereto of tie element 42, with said bolts 46, may be accomplished in the field with less effort and with less skilled labor than is the case in the embodiment of FIGS. 1 thru 7.

Figure 11:
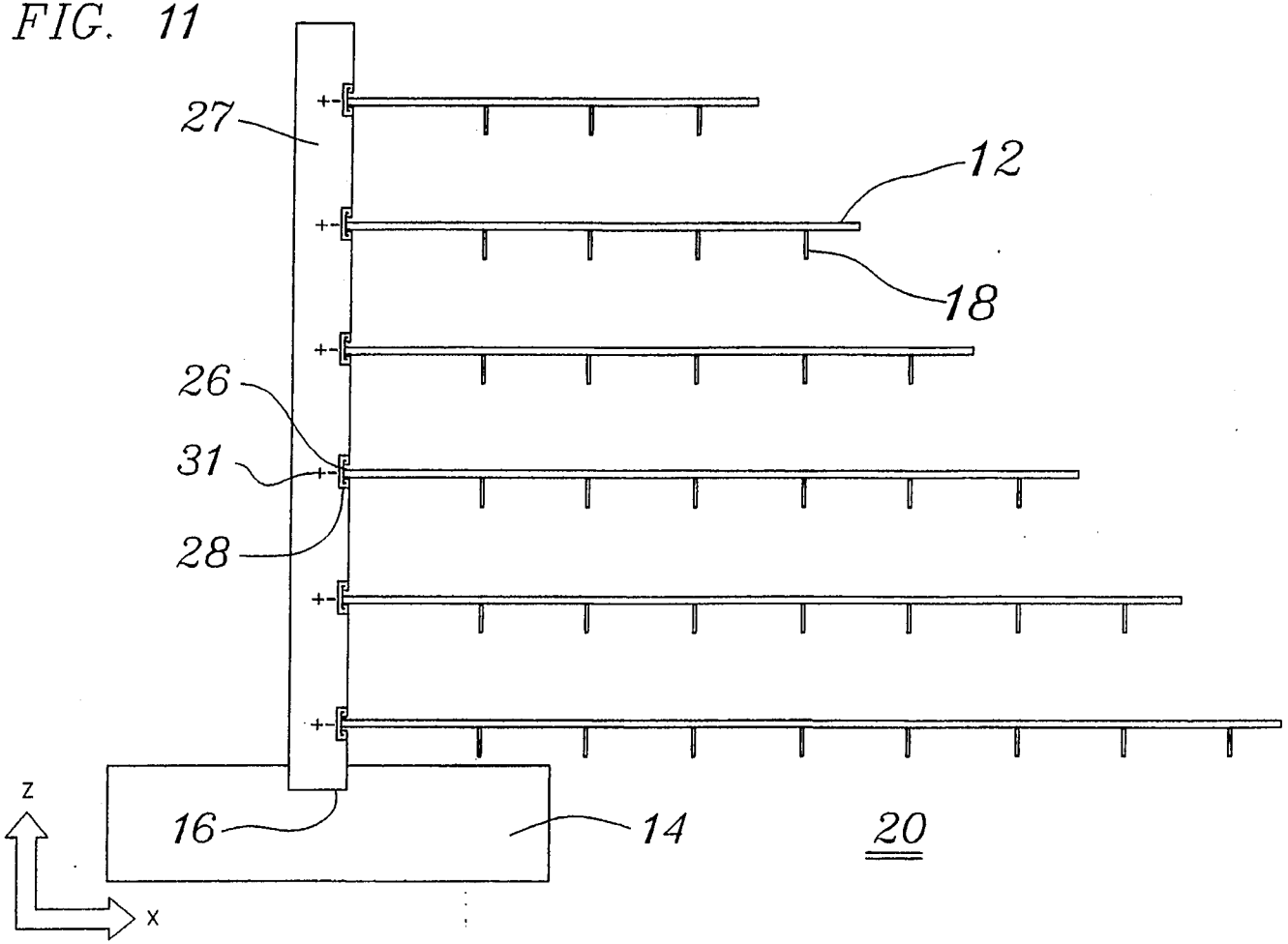
FIG. 11 is a view, similar to FIG. 2, however, showing coupling of the pressure resistive elements to the lower surface of the tie elements.

With reference to FIG. 11, it may be noted that tie elements 18 may be positioned downwardly, relative to tie elements 12, as opposed to upwardly as is shown in FIG. 2.

The present concept of the retaining wall considers the passive pressure exerted on a series of short vertical members, attached onto horizontally placed tension member to provide tensile force on the reinforcement, to balance the active stress imposed on the earth retaining wall by the filled earth. As the magnitude of the passive pressure is approximately 300%, the active pressure use of passive pressure to develop the tensile force in the reinforcement should provide an economical and convenient answer to retaining walls.

The retaining wall system of the present invention finds its most practical applications in situations where there is a difference of ground level elevation on either side of the wall. In cases where the wall is erected on relatively flat or slope terrain, as to serve as a water barrier, back-fill has to be placed behind the wall burying the passive members to develop necessary tension in the tie rods to prevent wall movement. The system is so designed as to be assembled as precast units at the site.

With respect to the horizontal and vertical arrangement of elements 12 and members 18 relative to each other, it is to be appreciated that, within the scope of the present invention, it is not essential that every pressure resistive element 18 be aligned underneath every other such element as is shown in FIGS. 1 and 2. Rather, a staggered arrangement in the x-axis may be employed. See FIGS. 3 and 5. Similarly, it is not essential that every tie element 12 be aligned over every other tie element. That is, a staggered arrangement may be used as well, although considerations of cost will generally dictate that single matrix configurations of the type shown in FIGS. 1 and 2 be employed.

Figure 12:
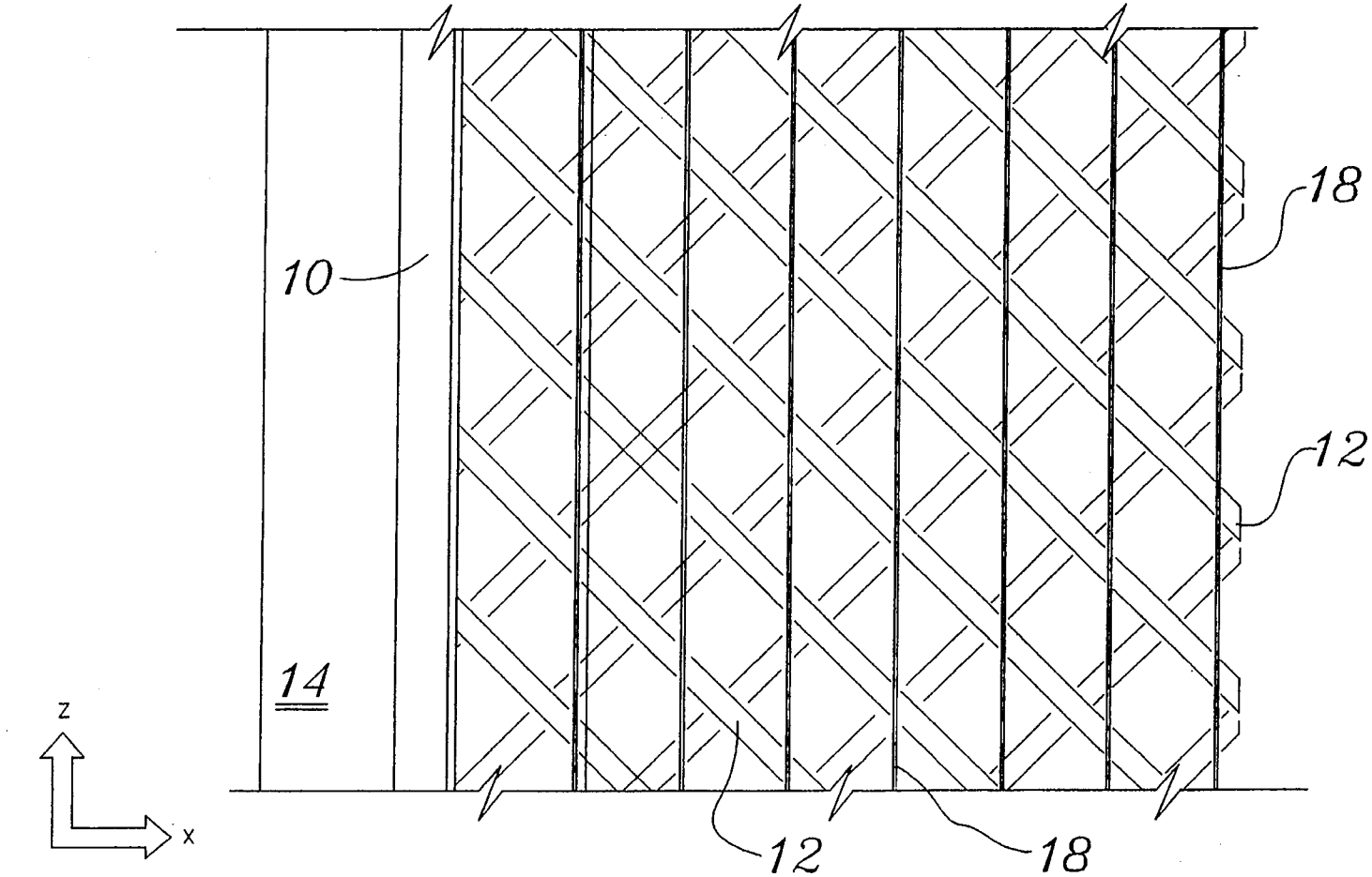
FIG. 12 is a perspective view of the embodiment of the inventive system showing the pressure resistive elements at an angle relative to the plane of the retaining wall.

With reference to FIG. 12 it is noted that, in a given embodiment, pressure resistive member 18 may exhibit an angle relative to the retaining wall surface 24. That is, the yz-plane of members 18 need not always be parallel to surface 24.

Figure 13:
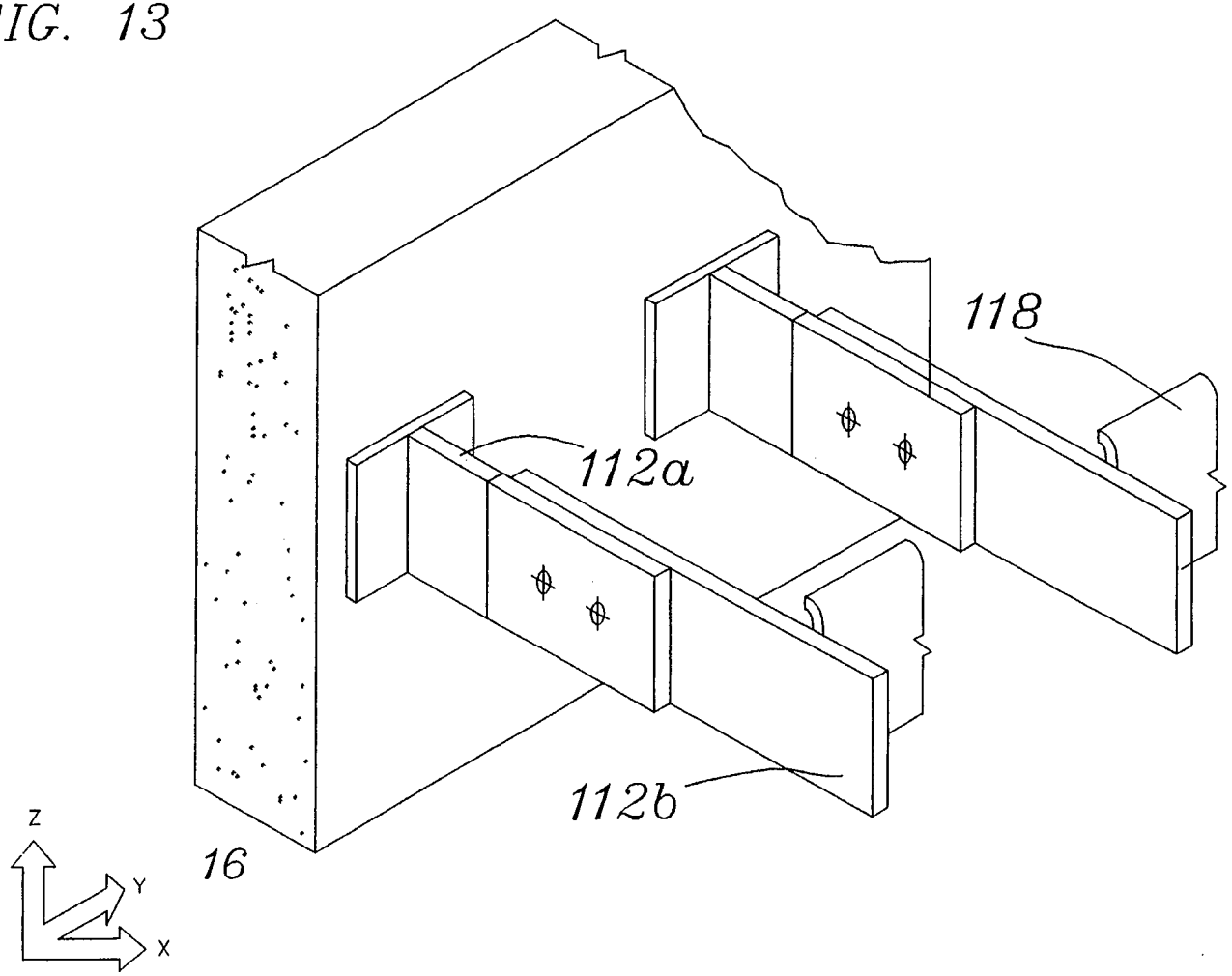
FIG. 13 is an isometric view of a further embodiment of the invention.
Figure 14:
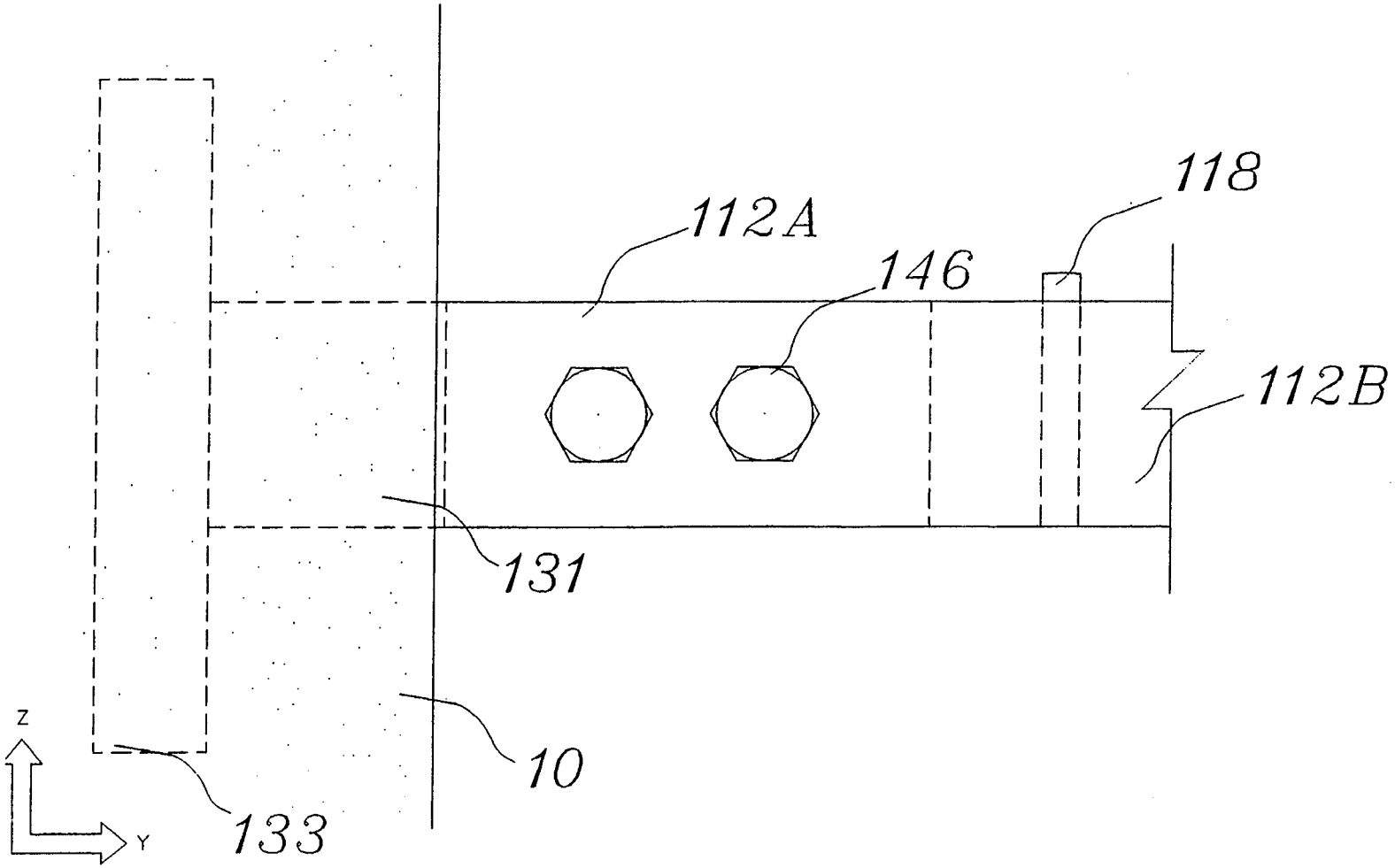
FIG. 14 is a side plan view of the embodiment of FIG. 13.

With reference to the views of FIGS. 13 and 14 there is shown an alternative embodiment of the instant invention in which tie elements 12 of the embodiments of FIGS. 1 thru 7 are turned vertically and in which, as in the embodiment of FIGS. 9 and 10, the tie element consists of two separate pieces one of which (element 112*a*) is pre-anchored into wall 10 during the production process of the wall 10 and a second element 112*b* of which is secured by bolt means 146 when the entire retaining wall system is assembled in the field. In this embodiment pressure resistive members 18 of FIGS. 1 thru 7 take the form of pressure resistive members 118 which connects to tie members 112*b* in the tongue-and-groove slotted fashion shown in FIG. 13.

The embodiment of FIGS. 13 and 14 differs from the other embodiments of the invention in that there does not exist any horizontal (xy) plane elements at all, a configuration which, in particular civil engineering situations, will constitute a more favorably design solution.

Accordingly, while there has been shown and described the preferred embodiment of the present invention it is to appreciated that the invention may be embodied otherwise than is herein specifically shown and described and that, within said embodiment certain changes may be made in the form and arrangement of the parts without departing from the underlying ideas or principles of this invention as set forth in the claims appended herewith.

Having thus described my invention what I claim as new, useful and non-obvious and, accordingly, secure by Letters Patent of the United States is:

1. An earth-retaining wall system, definable with reference to x, y and z Cartesian coordinate axes, for use with a retaining wall operative in the yz plane thereof, the system comprising:

(a) a plurality of tie elements substantially uniplanar in the xy plane and longitudinally elongated along the x-axis thereof, said tie elements each complementally rigidly coupled to an earth-supporting surface of said retaining wall, in a y-by-z axes matrix; and (b) a plurality of pressure resistive members substantially uniplanar in the yz plane and longitudinally elongated along the y-axis thereof, each of said pressure resistive members rigidly secured along xy plane surfaces of said tie elements in the same z-axis elevation of said y-by-z axes matrix of tie elements, said pressure resistive members defining, along z-axis edges thereof, a x-by-z axes matrix.

2. The system as recited in claim 1, in which said pressure resistive members are integral with said tie elements upon the positive z-axis surfaces thereof.

3. The system as recited in claim 1, in which said resistive members are integrated to said tie elements upon the negative z-axis surface thereof.

4. The system as recited in claim 2, in which a z-axis dimension each of said pressure resistive members comprises about one-tenth of the z-axis distance between z-axis rows of said tie elements.

5. The system as recited in claim 1, in which said x-by-z matrix of said tie elements comprises two x-by-z matrices having a x-axis offset relative to each other.

6. The system as recited in claim 1, in which said y-by-z axis matrix of said pressure resistive members comprises two y-by-z matrices having a y-axis offset relative to each other.

7. The system as recited in claim 5, in which said y-by-z axis matrix of said pressure resistive members comprises two y-by-z matrices having a y-axis offset relative to each other.

8. The system as recited in claim 1, in which said pressure resistive members are secured along their y-axis edges to said xy surfaces of said tie elements at a non-parallel angle relative to the yz axis of said retaining wall.

9. The system as recited in claim 1, in which positive z-axis edges of said pressure resistive members are curved in the direction of said retaining wall.

10. The system as recited in claim 1, in which the negative axis edges of said pressure resistive members which are integral, along their y-axis edges thereof, to the xy surface of said tie elements, include a buttressing geometry against said surface.

11. The system as recited in claim 3, in which said x-by-z matrix of said tie elements comprises two x-by-z matrices having a x-axis offset relative to each other.

12. The system as recited in claim 3, in which said y-by-z axis matrix of said pressure resistive members comprises two y-by-z matrices having a y-axis offset relative to each other.

13. The system as recited in claim 12, in which said y-by-z axis matrix of said pressure resistive members comprises two y-by-z matrices having a y-axis offset relative to each other.

14. An earth-retaining wall system, definable with reference to x, y, and z Cartesian coordinate axes, for use with a retaining wall operative in the yz plane thereof, the system:

(a) a plurality of tie elements substantially uniplanar in the xz plane and longitudinally elongated along the y-axis thereof, said tie elements each complementally rigidly coupled to an earth-supporting surface of said retaining wall, in a y-by-z axes matrix; and (b) a plurality of pressure resistive members substantially uniplanar in the yz plane and longitudinally elongated along the y-axis thereof, each of said pressure resistive members rigidly secured to xz plane surfaces of said tie elements in the same z-axis elevation of said y-by-z axes matrix of tie elements, said pressure resistive members defining, along z-axis edges thereof, a x-by-z axes matrix.

15. The system as recited in claim 14, in which said pressure resistive members are integral with said tie elements upon the positive z-axis surfaces thereof.

16. The system as recited in claim 14, in which said resistive members are integral with said tie elements upon the negative z-axis surfaces thereof.

17. The system as recited in claim 15, in which z-axis dimension each of said pressure resistive members comprises about one-tenth of the z-axis distance between z-axis rows of said tie elements.

18. The system as recited in claim 14, in which said x-by-z matrix of said tie elements comprises two x-by-z matrices having a x-axis offset relative to each other.

19. The system as recited in claim 14, in which said y-by-z axis matrix of said pressure resistive members comprises two y-by-z matrices having a y-axis offset relative to each other.

20. The system as recited in claim 18, in which said y-by-z axis matrix of said pressure resistive members comprises two y-by-z matrices having a y-axis offset relative to each other.

21. The system as recited in claim 14, in which said pressure resistive members are secured along their y-axis edges to said xy surfaces of said tie elements at a non-parallel angle relative to the yz axis of said retaining wall.

22. The system as recited in claim 14, in which positive z-axis edges of said pressure resistive members are curved in the direction of said retaining wall.

23. The system as recited claim 14, in which the negative axis edges of said pressure resistive members which are integral, along their y-axis edges thereof, to the xy surface of said tie elements, include a buttressing geometry against said surface.

24. The systems as recited in claim 16, in which said x-by-z matrix of said tie elements comprises two x-by-z matrices having x-axis offset relative to each other.

25. The system as recited in claim 16, in which said y-by-z axis matrix of said pressure resistive members comprises two y-by-z matrices having a y-axis offset relative to each other.

26. The system as recited in claim 25, in which said y-by-z axis matrix of said pressure resistive members comprises two y-by-z matrices having a y-axis offset relative to each other.

* * * * *